US010682690B2

(12) United States Patent
Joo et al.

(10) Patent No.: US 10,682,690 B2
(45) Date of Patent: Jun. 16, 2020

(54) CENTRIFUGAL CASTING APPARATUS FOR DIFFERENT MATERIALS

(71) Applicants: HYUNDAI MOTOR COMPANY, Seoul (KR); KIA MOTORS CORPORATION, Seoul (KR)

(72) Inventors: Hyo-Moon Joo, Seoul (KR); Ji-Yong Lee, Seoul (KR); Yoon-Ki Lee, Hwaseong-Si (KR); Young-Chan Kim, Suwon-si (KR); Cheol-Ung Lee, Busan (KR); Jun-Min Lee, Seoul (KR); Mun-Gu Kang, Suwon-si (KR); Young-Rae Cho, Hwaseong-si (KR); Min-Soo Kim, Seoul (KR); Jae-Gi Sim, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/205,823

(22) Filed: Nov. 30, 2018

(65) Prior Publication Data

US 2019/0168294 A1 Jun. 6, 2019

(30) Foreign Application Priority Data

Dec. 6, 2017 (KR) ..... 10-2017-0167026

(51) Int. Cl.
*B22D 19/16* (2006.01)
*B22D 13/10* (2006.01)

(52) U.S. Cl.
CPC ..... *B22D 13/107* (2013.01); *B22D 19/16* (2013.01)

(58) Field of Classification Search
CPC ..... B22D 19/16; B22D 13/107
See application file for complete search history.

(56) References Cited

U.S. PATENT DOCUMENTS 5,244,187 A * 9/1993 Manginelli ..... B22D 35/04 164/129

FOREIGN PATENT DOCUMENTS

JP 55144371 A * 11/1980
KR 10-2009-0032465 A 4/2009

* cited by examiner

*Primary Examiner* — Kevin E Yoon
(74) *Attorney, Agent, or Firm* — Morgan, Lewis & Bockius LLP

(57) ABSTRACT

A centrifugal casting apparatus for different materials may include a mold having a shape corresponding to a shape of an outer surface of a casting to be produced, and having a cavity receiving molten metals therein, a molten metal guide inserted into the mold and configured to guide the molten metals so that the molten metals are separately injected into the mold, a guide fixing support fixing the molten metal guide to a predetermined position, and a motor configured to rotate the mold around a rotation axis.

12 Claims, 6 Drawing Sheets

-PRIOR ART-

CENTRIFUGAL CASTING APPARATUS FOR DIFFERENT MATERIALS

CROSS-REFERENCE(S) TO RELATED APPLICATIONS

This application claims priority to Korean Patent Application No. 10-2017-0167026, filed on Dec. 6, 2017, which is incorporated herein by reference in its entirety.

TECHNICAL FIELD

The present disclosure relates to a centrifugal casting apparatus for a centrifugal casting process, and particularly, to a centrifugal casting apparatus for casting different materials.

BACKGROUND

A centrifugal casting process is a casting process of forming a casting in such a way that centrifugal force is applied to molten metal by rotating a mold. In other words, this is a process in which centrifugal force may act uniformly on the entirety of the mold by the rotation of the mold so that the casting process may be performed while pressure is applied to the molten metal.

Since the mold is rotated at high speed of 300 to 3000 RPM, it is possible to obtain a dense structure by the centrifugal force. In addition, it is possible to produce a casting of a high quality through the separation of impurities using a difference in specific gravity. Thus, the centrifugal casting process is being widely applied to circular components including a pipe, a water pump pulley, a damper pulley hub and the like, as well as components, such as an inner core, having various shapes.

However, the centrifugal casting process is problematic in that RPM may not be increased beyond a certain level, due to practical problems including the problem of equipment, the spreading of molten metal and the like.

Therefore, when casting is performed, the RPM may not be sufficiently high.

If the RPM is low, the casting is affected by the gravity and the centrifugal force, as illustrated in FIG. 1. In this case, since force is intensively applied in the direction of a resultant force of the gravity and the centrifugal force and a certain part is subjected to less force, it is difficult to secure the castability due to a difference in casting pressure, and a difference in physical properties may occur.

FIG. 2 illustrates a water pump pulley made of a single material by centrifugal casting. As shown in portion A of FIG. 2, a non-molded part may occur because of the directivity of pressing.

On the one hand, in an aluminum casting process for achieving a reduction in weight, it is advantageous to make one product using two different materials by casting. Therefore, a current trend in a casting field is towards hybrid casting of metal.

That is, a required material may be used only for a required part so that the required material can serve as a functional material, thus realizing a reduction in cost and weight.

For example, a retainer component of a transmission requires abrasion resistance on a surface thereof. Thus, if the surface of the component is made of K14 by casting and an interior thereof is made of ADC12 by casting, it is possible to realize a reduction in cost and weight.

The foregoing is intended merely to aid in the understanding of the background of the present disclosure, and is not intended to mean that the present disclosure falls within the purview of the related art that is already known to those skilled in the art.

SUMMARY

The present disclosure is directed to a centrifugal casting apparatus for different materials, capable of simultaneously casting different materials through a centrifugal casting process, and improving moldability and bondability.

In accordance with an embodiment of the present disclosure, there is provided a centrifugal casting apparatus for different materials including a mold having a cavity to receive molten metals therein, wherein the cavity has a shape corresponding to that of an outer surface of a casting to be produced, a molten metal guide inserted into the mold and configured to guide the molten metals so that the molten metals are separately injected into the mold, a guide fixing support fixing the molten metal guide to a predetermined position, and a motor configured to rotate the mold around a rotation axis.

An external molten metal inlet may be in a top of the mold to allow an external molten metal to be injected, and an internal molten metal inlet may be in a top of the molten metal guide to allow an internal molten metal different from the external molten metal to be injected.

The molten metal guide may include an upper surface extending obliquely in a radial direction from a lower end of the internal molten metal inlet, and a side surface extending downwards from the upper surface.

The internal molten metal inlet of the molten metal guide may have a width less than a width of the external molten metal inlet of the mold.

An upper end of the internal molten metal inlet of the molten metal guide may be higher than an upper end of the external molten metal inlet of the mold.

The molten metal guide may be a mesh type member.

The molten metal guide may partially pass through a guide hole in a lower surface of the mold, and the guide fixing support may be a guide fixing member that may surround inner and outer surfaces of the molten metal guide passing through the guide hole.

The guide fixing support may hydraulically fix the internal molten metal inlet of the molten metal guide.

A lower end of the molten metal guide may not be fixed to the lower surface of the mold.

DETAILED DESCRIPTION OF SPECIFIC EMBODIMENTS

Exemplary embodiments of the present disclosure will be described below in more detail with reference to the accompanying drawings so as to make those skilled in the art fully understand operational advantages and objects of the present disclosure.

In the description of exemplary embodiments of the disclosure, the description of known technology or a duplicated description may be omitted to avoid obscuring appreciation of the disclosure.

Figure 1:
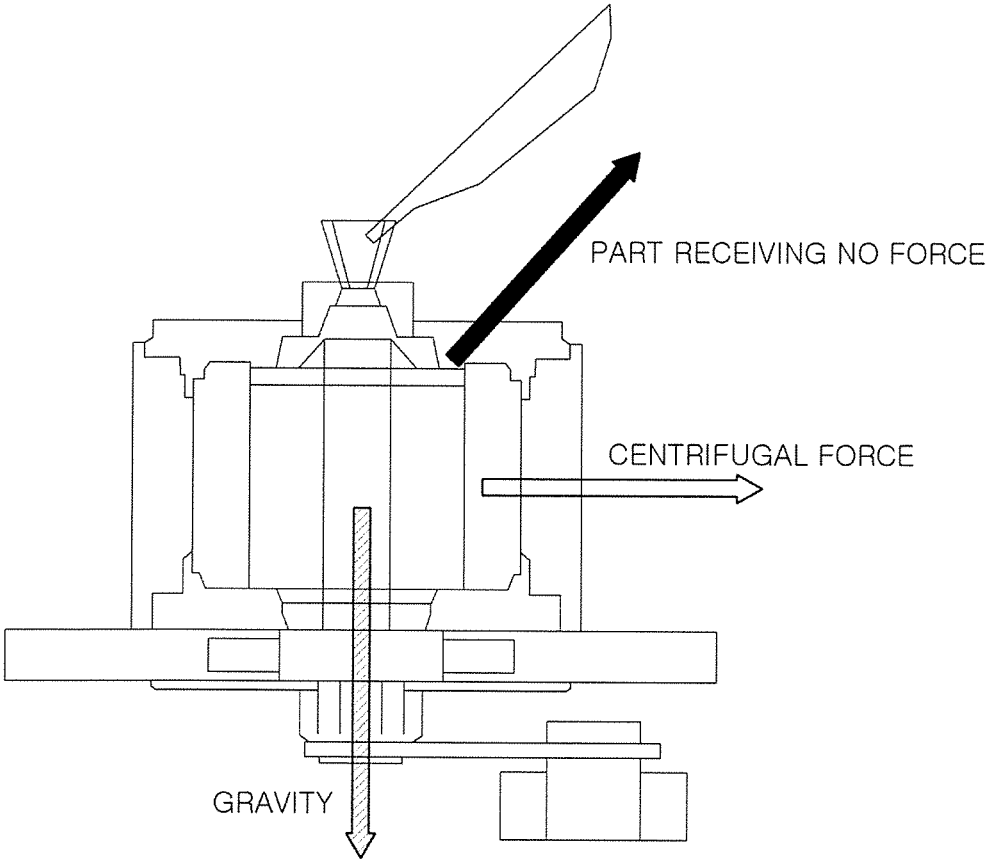
FIG. 1 is a view illustrating a relation of a pressing force in conventional centrifugal casting.
Figure 2:
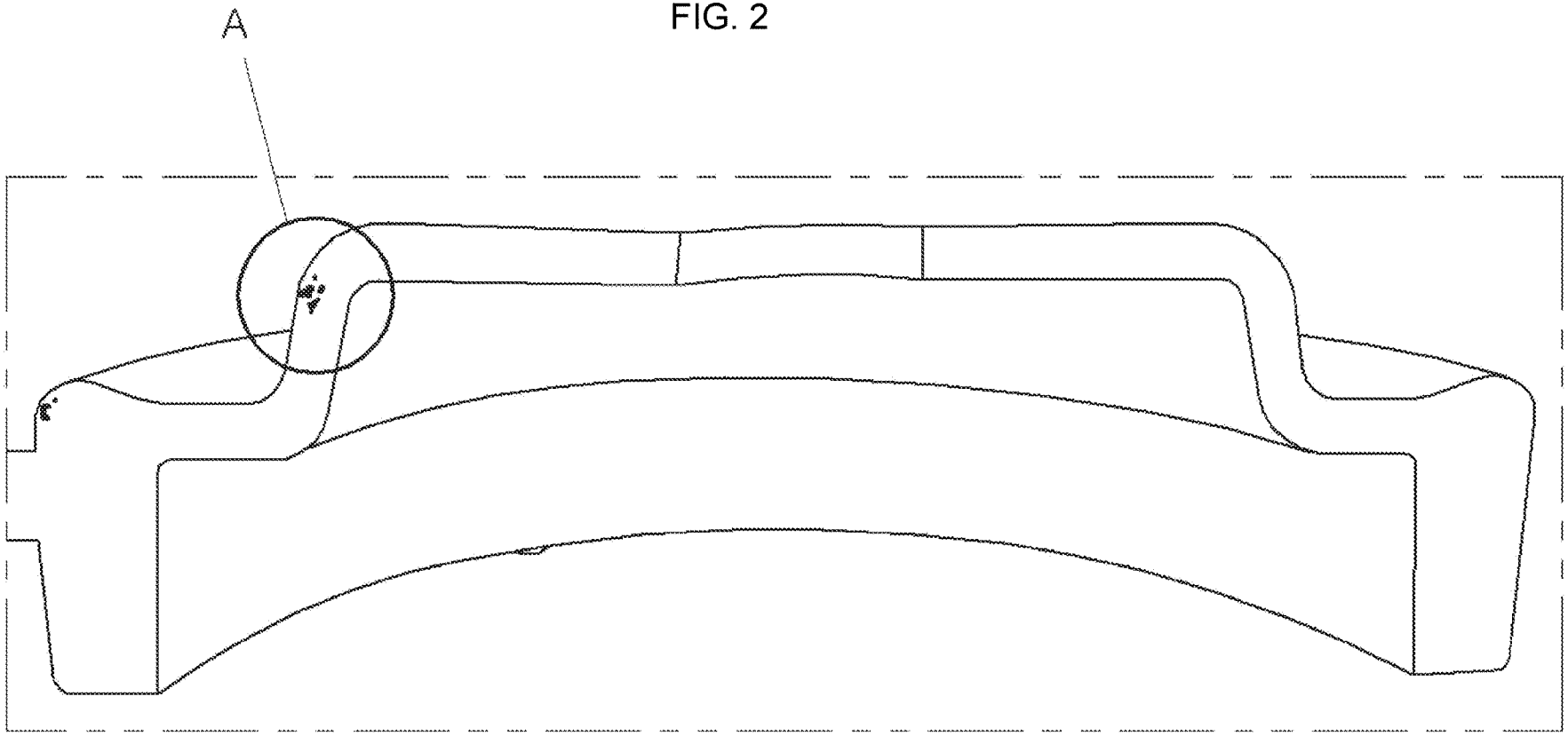
FIG. 2 (Prior Art)
FIG. 2 is a view illustrating an example of a product manufactured using a single material by conventional centrifugal casting.
Figure 3:
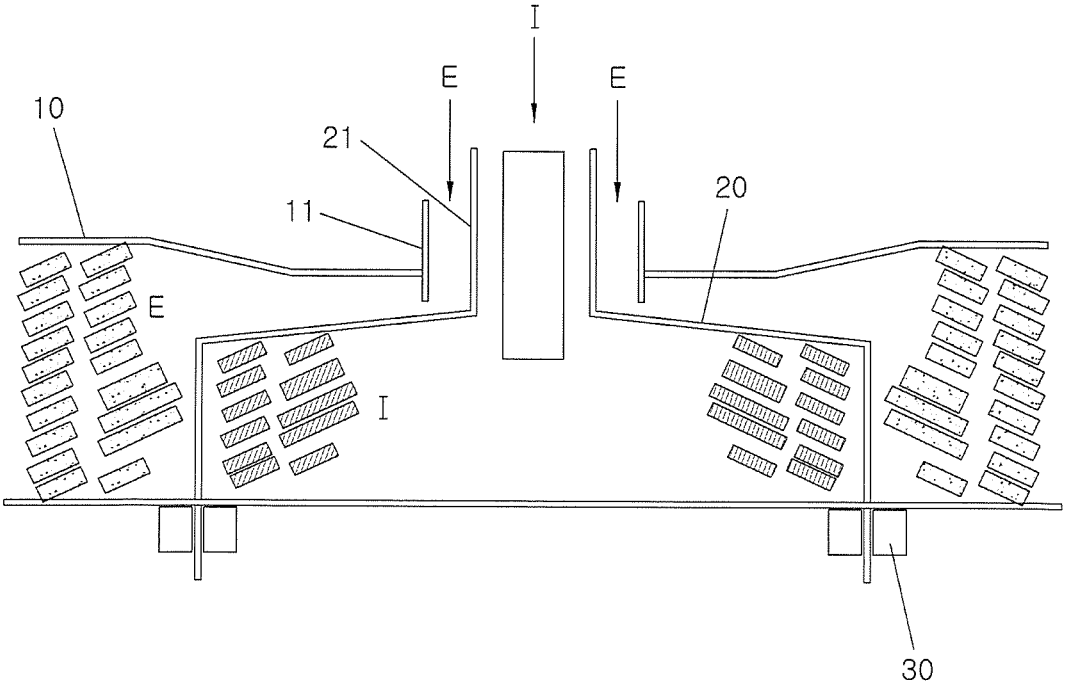
FIG. 3 is a view illustrating a centrifugal casting apparatus for different materials according to an embodiment of the present disclosure.
Figure 4:
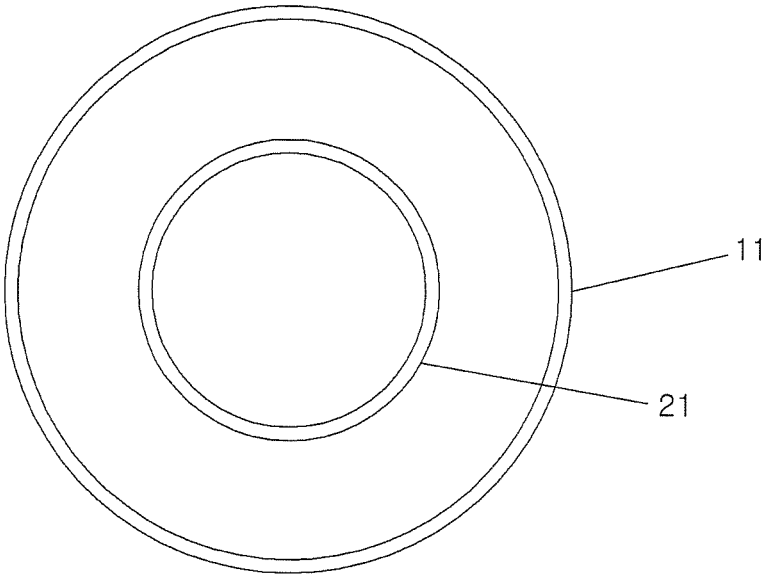
FIG. 4 is a plan view of a portion of FIG. 3.

FIG. 3 is a view illustrating a centrifugal casting apparatus for different materials according to an embodiment of the present disclosure, and FIG. 4 is a plan view of a portion of FIG. 3.

Hereinafter, the centrifugal casting apparatus for different materials according to an embodiment of the present disclosure will be described with reference to FIGS. 3 and 4.

The centrifugal casting apparatus for different materials according to an embodiment of the present disclosure is a centrifugal casting apparatus which rotates a mold around a rotation axis using a motor or the like and presses molten metal injected into the mold by centrifugal force, thus performing a casting operation. The motor is not shown in the drawings.

The centrifugal casting according to an embodiment of the present disclosure apparatus includes a mold 10 which has cavity formed to receive molten metal therein, wherein the cavity has a shape corresponding to that of an outer surface of a casting to be produced, a molten metal guide 20 which is inserted into the mold 10 to allow an internal molten metal I and an external molten metal E to be separately injected, and a guide fixing support which fixes the molten metal guide 20 to a predetermined position.

An external molten metal inlet 11 is formed in a top of the mold 10 to allow the external molten metal E to be injected, while an internal molten metal inlet 21 is formed in a top of the molten metal guide 20 to allow the internal molten metal I to be injected.

The molten metal guide 20 obliquely extends in a radial direction from a lower end of the internal molten metal inlet 21 to partition the cavity of the mold 10, thus forming an upper surface. Furthermore, side surfaces of the molten metal guide 20 extend downwards, whereby the molten metal guide 20 along with a lower surface of the mold 10 defines therein a space having a predetermined volume.

Each of the mold 10 and the molten metal guide 20 may have a circular cross-sectional shape.

As illustrated in the drawing, the internal molten metal inlet 21 of the molten metal guide 20 may have a width less than that of the external molten metal inlet 11 of the mold 10, and an upper end of the internal molten metal inlet 21 is formed to be higher than an upper end of the external molten metal inlet 11 when the molten metal guide 20 is seated in the mold 10.

That is, in order to allow the internal molten metal I and the external molten metal E to be separately injected, the upper end of the internal molten metal inlet 21 should be higher than the upper end of the external molten metal inlet 11 so that the internal molten metal I and the external molten metal E can be reliably separately injected and prevented from being mixed with each other.

In this way, in the centrifugal casting apparatus according to an embodiment of the present disclosure, the inlets 11 and 21 are separated from each other by the molten metal guide 20, so that the external molten metal E is injected into a space defined outside the molten metal guide 20 via the external molten metal inlet 11, and the internal molten metal I is injected into a space defined in the molten metal guide 20 via the internal molten metal inlet 21, and then the casting operation is performed. As a result, it is possible to simultaneously perform the centrifugal casting for the different materials.

Furthermore, the guide fixing support for fixing the molten metal guide 20 may be a guide fixing member 30 provided under the lower surface of the mold 10, as illustrated in the drawing.

In order to fix the molten metal guide 20, a guide hole through which a lower part of the molten metal guide 20 may pass is formed in the lower surface of the mold 10. Thus, a part of the molten metal guide 20 is exposed downward from the lower surface of the mold 10. As illustrated in the drawing, the guide fixing member 30 surrounding inner and outer surfaces of the lower part of the molten metal guide 20 passing through the guide hole is fixed with the molten metal guide 20 by means of a bolt. Therefore, when the molten metal is injected, the molten metal guide 20 may be fixed to a predetermined position.

Since the molten metal guide is fixed to a predetermined position by the guide fixing member, it is possible to prevent the molten metal guide from being radially shifted by the centrifugal force.

The centrifugal casting apparatus according to an embodiment of the present disclosure is installed as follows. First, the mold 10 opens, and the molten metal guide 20 is inserted and fixed to a predetermined position through the guide hole. Thereafter, the molten metal guide 20 is fixed by the guide fixing member 30 and then the mold is closed.

Rotating force is applied to the mold 10 at a predetermined RPM, and the internal molten metal I is injected through the internal molten metal inlet 21. As the internal molten metal I presses the molten metal guide 20 by the centrifugal force, it easily comes into contact with the molten metal guide 20.

After the internal molten metal I has been injected and solidified, the guide fixing member 30 is removed by cutting. By cutting the protruding lower part of the molten metal guide 20, undercut may also be prevented and a cut part may be used again as a scrap.

Subsequently, the external molten metal E is injected through the external molten metal inlet 21.

That is, if the internal molten metal I has been solidified, the molten metal guide 20 does not need to be fixed to a predetermined position any more. After the guide fixing member 30 has been cut, the molten metal guide 20 is subjected to upward force by the rotating force.

This force is used during the casing operation as the pressing force for the external molten metal pertaining to a part that is not subjected to satisfactory force due to insufficient pressing force in the related art. Furthermore, if the lower end of the molten metal guide 20 integrated with the internal molten metal I comes off from the inner surface of the mold 10, the internal molten metal I comes into contact with the external molten metal E through a gap between the lower end of the molten metal guide 20 and the inner surface of the mold 10, so that it is possible to achieve a stronger finished product.

In order to ensure castability at a junction between the external molten metal E and the molten metal guide 20, the molten metal corresponding to about 130% to 150% of the cavity may be supplied or a riser may be provided in the cavity.

The internal molten metal I and the external molten metal E are controlled such that they have different injection times, injection amounts and rotating speeds. Thus, it is possible to differently control the castability and the centrifugal force acting on each molten metal.

Thereafter, if the external molten metal E has been solidified, the mold 10 opens and a cast product is taken out from the mold.

Here, according to an embodiment of the present disclosure, the molten metal guide 20 may be made of an aluminum material ADC12, and provided in the form of a mesh type member.

In the case of casting different materials, if they are not chemically bonded but are simply physically boned to each other, several problems may occur at an interface.

Firstly, a breakage may be initiated at the interface due to the formation of pores and generation of defects at the interface. Therefore, the design shape of the interface and the interaction between the materials are important.

Secondly, galvanic corrosion may occur between two materials. The galvanic corrosion is corrosion occurring when different kinds of metals come into contact with each other and there is a potential difference between the metals. This may accelerate the corrosion of one material and may negatively affect the life of a component.

In order to solve the problem, the molten metal guide 20 of the present disclosure may be formed as the aluminum mesh type.

This may prevent the galvanic corrosion from occurring, and allows the molten metal to fill the pores of the mesh type, thus preventing pores and defects from occurring to the maximum and allowing bonding to be made at the interface.

Figure 5:
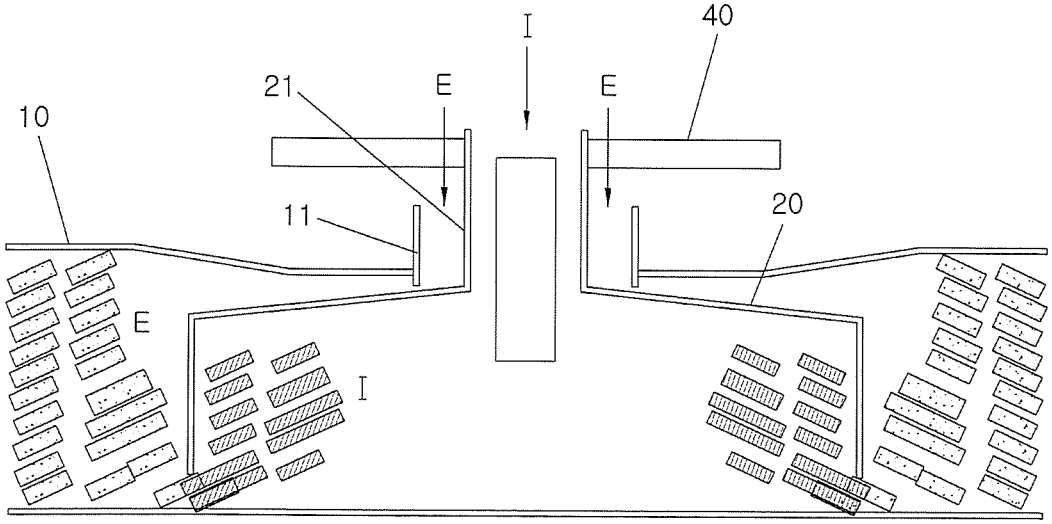
FIG. 5 is a view illustrating a centrifugal casting apparatus for different materials according to another embodiment of the present disclosure.
Figure 6:
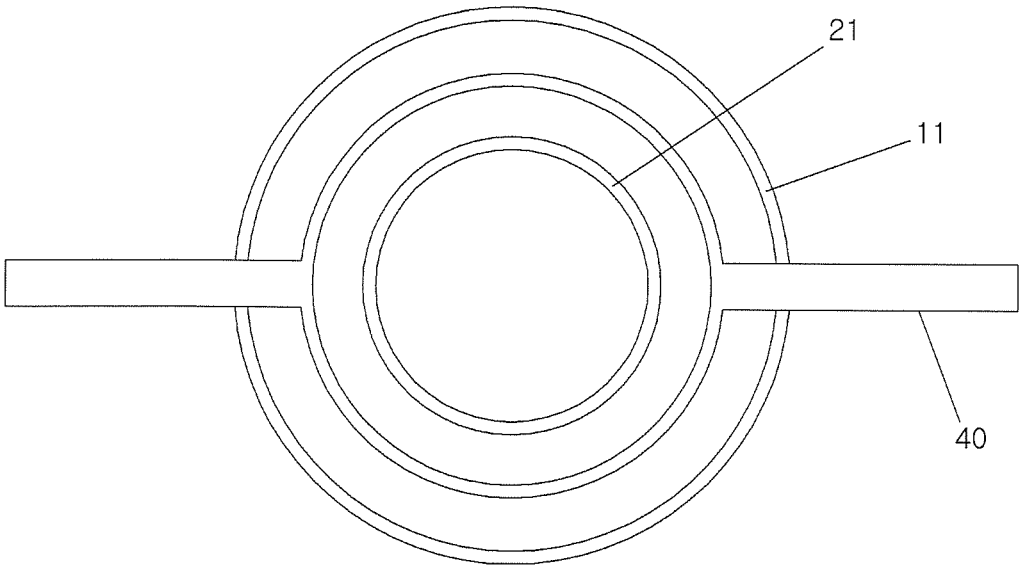
FIG. 6 is a plan view of a portion of FIG. 5.

FIG. 5 is a view illustrating a centrifugal casting apparatus for different materials according to another embodiment of the present disclosure, and FIG. 6 is a plan of a portion of FIG. 5.

Hereinafter, the centrifugal casting apparatus for different materials according to this embodiment of the present disclosure will be described with reference to FIGS. 5 and 6. However, the description of the same technical aspects as those of the preceding embodiment will be omitted.

The centrifugal casting apparatus for different materials according to this embodiment of the present disclosure is different from that of the preceding embodiment in the guide fixing support of the molten metal guide 20.

That is, the molten metal guide 20 of this embodiment is not directly fixed to the mold 10, and a lower end of the molten metal guide is free from the bottom of the mold 10.

Instead, the internal molten metal inlet 21 located at an upper position is fixed using hydraulic pressure of a hydraulic fixing device 40.

The molten metal guide 20 is supported at an upper position by the hydraulic fixing device 40 using a hydraulic cylinder, so that the molten metal guide 20 is fixed to a predetermined position when the molten metal is injected. If the hydraulic pressure is released similarly to the cutting of the guide fixing member 30 in the preceding embodiment, the molten metal guide 20 is subjected to upward pressing force.

Furthermore, the internal molten metal I comes into contact with the external molten metal E through a gap between the lower end of the molten metal guide 20 and the bottom of the mold 10, so that the internal molten metal, the molten metal guide, and the external molten metal are more firmly coupled with each other, and consequently it is possible to achieve a stronger finished product.

As described above, the present disclosure provides a centrifugal casting apparatus for different materials, which allows a casting to be made of different materials by centrifugal casting, thus reducing a cycle time and thereby simplifying a process, reducing cost and enabling a product having better physical properties to be manufactured as compared to simple bonding.

In addition, pressing force acts on a part that is subjected to less force in the case of common centrifugal casting, so that better moldability is realized.

Furthermore, as different materials are mixed through a lower area of a molten metal guide, bonding force between the different materials is increased and consequently the stability of a finished product may be enhanced.

As a result, the rigidity of a product may be improved as compared to the related art, so that it is possible to realize a reduction in weight of the product by reducing a thickness.

Further, since special materials may be applied unlike the centrifugal casting for a single material, it is advantageous for reducing the production cost.

While the present disclosure has been described with respect to the specific embodiments, it will be apparent to those skilled in the art that various changes and modifications may be made without departing from the spirit and scope of the invention as defined in the following claims.

What is claimed is:

1. A centrifugal casting apparatus for different materials comprising:

a mold having a cavity for receiving molten metals therein, wherein the cavity has a shape corresponding to a shape of an outer surface of a casting to be produced;

a molten metal guide inserted into the mold and configured to guide the molten metals so that the molten metals are separately injected into the mold;

a guide fixing support fixing the molten metal guide to a predetermined position; and a motor configured to rotate the mold around a rotation axis, wherein the molten metal guide includes an internal molten metal inlet to inject an internal molten metal through the internal molten metal inlet, wherein the molten metal guide comprises: an upper surface extending obliquely in a radial direction from a lower end of the internal molten metal inlet; and a side surface extending downward toward a lower surface of the molten metal guide from the upper surface.

2. The centrifugal casting apparatus of claim 1, wherein the mold includes an external molten metal inlet to inject an external molten metal through the external molten metal inlet, wherein the internal molten metal is different from the external molten metal.

3. The centrifugal casting apparatus of claim 2, wherein the mold includes the external molten metal inlet at a top of the mold, and wherein the molten metal guide includes the internal molten metal inlet at a top of the molten metal guide.

4. The centrifugal casting apparatus of claim 2, wherein the internal molten metal inlet of the molten metal guide has a width less than a width of the external molten metal inlet of the mold.

5. The centrifugal casting apparatus of claim 2, wherein an upper end of the internal molten metal inlet of the molten metal guide is higher than an upper end of the external molten metal inlet of the mold.

6. The centrifugal casting apparatus of claim 1, wherein the molten metal guide is a mesh type member.

7. The centrifugal casting apparatus of claim 6, wherein the mold has a guide hole in a lower surface of the mold such that the molten metal guide partially passes through the guide hole, wherein the guide fixing support surrounds inner and outer surfaces of the molten metal guide passing through the guide hole.

8. The centrifugal casting apparatus of claim 6, wherein the guide fixing support fixes the internal molten metal inlet of the molten metal guide using a hydraulic pressure.

9. The centrifugal casting apparatus of claim 1, wherein the mold has a guide hole in a lower surface of the mold such that the molten metal guide partially passes through the guide hole, wherein the guide fixing support surrounds inner and outer surfaces of the molten metal guide passing through the guide hole.

10. The centrifugal casting apparatus of claim 1, wherein the guide fixing support fixes the internal molten metal inlet of the molten metal guide using a hydraulic pressure.

11. The centrifugal casting apparatus of claim 10, wherein a lower end of the molten metal guide is apart from a lower surface of the mold.

12. The centrifugal casting apparatus of claim 1, wherein the molten metal guide is made of an aluminum material.

* * * * *